United States Patent [19]

Durbin

[11] 4,254,932

[45] Mar. 10, 1981

[54] CONCRETE WALL FORMING SYSTEM

[76] Inventor: James Durbin, 2000 Old Lost Mountain Rd., Powder Springs, Ga. 30073

[21] Appl. No.: 71,851

[22] Filed: Sep. 4, 1979

Related U.S. Application Data

[62] Division of Ser. No. 910,027, May 26, 1978, Pat. No. 4,192,481.

[51] Int. Cl.[3] ..... E04G 17/06

[52] U.S. Cl. ..... 249/42; 249/18; 249/23; 249/25; 249/36; 249/38; 249/40; 249/45; 249/216; 249/219 W

[58] Field of Search ..... 249/42, 219 R, 219 W, 249/213, 18, 21, 22, 25, 36, 38, 40, 44, 45, 46, 47, 216, 23

[56] References Cited

U.S. PATENT DOCUMENTS

| | | | |
|---|---|---|---|
| 2,161,379 | 6/1939 | Neptune | 249/40 |
| 3,060,541 | 10/1962 | Hillberg | 249/40 |
| 3,315,937 | 4/1967 | Eriksson | 249/44 |
| 3,693,931 | 9/1972 | Holt | 249/46 |
| 3,767,158 | 10/1973 | Mikus | 249/40 |
| 4,034,957 | 7/1977 | Cody | 249/18 |
| 4,068,818 | 1/1978 | Gates | 249/46 |
| 4,147,322 | 4/1979 | Dahlstrom | 249/40 |

*Primary Examiner*—Donald J. Arnold

*Attorney, Agent, or Firm*—Jones, Thomas & Askew

[57] ABSTRACT

A concrete wall form includes a support structure comprising a beam capable of functioning as a stringer or stiffback and which includes a bolt holding channel, a nailer channel and an internal channel for telescopically receiving an extension splice. A tie rod locking system is associated with the support structure for readily adjusting the forms.

3 Claims, 6 Drawing Figures

CONCRETE WALL FORMING SYSTEM

This is a division of application Ser. No. 910,027, filed May 26, 1978, now U.S. Pat. No. 4,192,481.

BACKGROUND OF THE INVENTION

The present invention relates to a system of concrete wall forms and the elements used to fabricate the forms.

When pouring concrete to form a concrete wall, forms must be built to hold the wet concrete in proper shape until it has dried and set. A wall form generally comprises two opposing plywood forms or other flat sheet material which define a wall cavity between them. Concrete is poured into the wall cavity and allowed to dry, taking the form of the cavity. The plywood forms must be braced to hold them in place and to prevent them from bowing under the weight of the concrete, and to this end, each plywood form is backed by a support structure. The support structures are tied together by tie rod assemblies spanning the wall cavity between the two plywood forms.

The support structures usually include a series of parallel braces called stringers which are backed by a series of parallel braces called stiffbacks or whalers running at right angles to the stringers. Commonly, lumber such as 2×4's or 2×8's is used as stringers and whalers. Lumber braces are somewhat bendable and flexible, requiring a large number of stringers and stiffbacks to achieve sufficient support and often requiring additional shoring up. Thus, construction of the forms is tedious and time consuming. Lumber stiffbacks must be nailed to the stringers and they are difficult to shift from side to side if adjustments become necessary.

In some cases builders have used steel or aluminum braces, the most common of which are z-shaped beams or channel beams. Such metal beams cannot be nailed to the wall forms since they have no woodlike nailer surface and must therefore be bolted to the forms and also to the stiffbacks, requiring added time in construction and adjustment. H-shaped extruded beams also have been developed for use as stringers, having attachable nailers for nailing on plywood forms. These beams have the disadvantage that they come in a number of preformed sizes and must be cut down to fit odd lengths of wall.

SUMMARY OF THE INVENTION

Briefly described, the present invention comprises a concrete wall form system including plywood forms spaced apart to form a wall space therebetween, which is to be filled with concrete. Each plywood form is backed by a support structure which utilizes a uniquely formed extruded H-shaped beam as at least one of its bracing components. The invention addresses itself as to a system of forming flat walls in which both the stringers and stiff backs are identically formed, generally H-shaped beams, and also to a system of forming curved walls in which only the stringers are the H-shaped beams and the stiffbacks are rolled channel beams. Each H-shaped beam accepts a rectilinear splice or extension beam telescopically within its central portion for readily extending the length of the beam when necessary to accommodate odd sized walls.

The plywood wall forms are held in spaced parallel relationship with respect to one another by upper and lower tie rod assemblies which span the space between the wall forms which is to be filled with concrete. The lower tie rod assemblies pass through the concrete wall itself and are partially irretrievable, while the upper assemblies cross above the concrete wall and are totally retrievable. The tie rod assemblies are connected to the form structures at uniquely designed tie rod plates which are mounted to the beams of the support structure. This inventive arrangement of the rod assemblies and tie rod plates allows for easy adjustment of the width of the space between the wall forms.

Since, in the flat wall form, the same I-shaped beams can be used as stringers or stiffbacks, time is saved in selection of beams during construction of the forms. The beams are lightweight and easy for workmen to handle.

The rigidity of the beams allows for fewer bracing beams to be utilized, in comparison to board braces, to accomplish proper support. This results in faster construction, lighter forms and fewer component parts to haul from one job site to another.

The extendable splice which is telescopically inserted in the H-shaped beam provides for a quick and easy method of extending beams to cover odd length walls. Full length beams need no longer be wasted by cutting them into short pieces. Workmen's time and energy is conserved.

The tie rod assemblies in conjunction with the newly designed tie rod plates provide a quick, easy method of adjusting the width of the wall space or concrete space, both widening and narrowing it, by simply turning a tie rod nut.

The concept and use of totally retrievable upper tie rods results in fewer parts being sacrificially left in the concrete and results in fewer assembly parts since the upper assembly is nearly one threaded rod, all of which saves contractors money. Also, the upper tie rods, which cross over the top of the wall forms, make it possible to align the wall after concrete has been poured, a function not accomplished by prior wall form systems.

The concept of using a rolled channel beam as a stiffback in curved wall forms reduces the time and cost involved in constructing curved forms by providing the contractor with the ability to reroll the same beam to repeatedly change the radius to any desired radius.

Thus, it is an object of the present invention to provide a concrete wall form which uses identically shaped extruded beams for both stringers and stiffbacks.

Another object of this invention is to provide a wall form which is easily and quickly assembled and readily adjusted.

Another object of the present invention is to provide a concrete wall form which includes a wall space adjustable by tie rod assemblies, some assemblies of which are totally retrievable after the concrete has been poured.

Yet another object of the present invention is to provide a concrete wall form which includes an extendable beam which can be readily lengthened to fit odd lengthed walls.

Still another object of this invention is to provide a method of assembling and adjusting concrete wall forms.

Other objects, features and advantages of the present invention will become apparent upon reading the following specification, when taken in conjunction with the accompanying drawing.

DETAILED DESCRIPTION OF THE DRAWINGS

Figure 1:
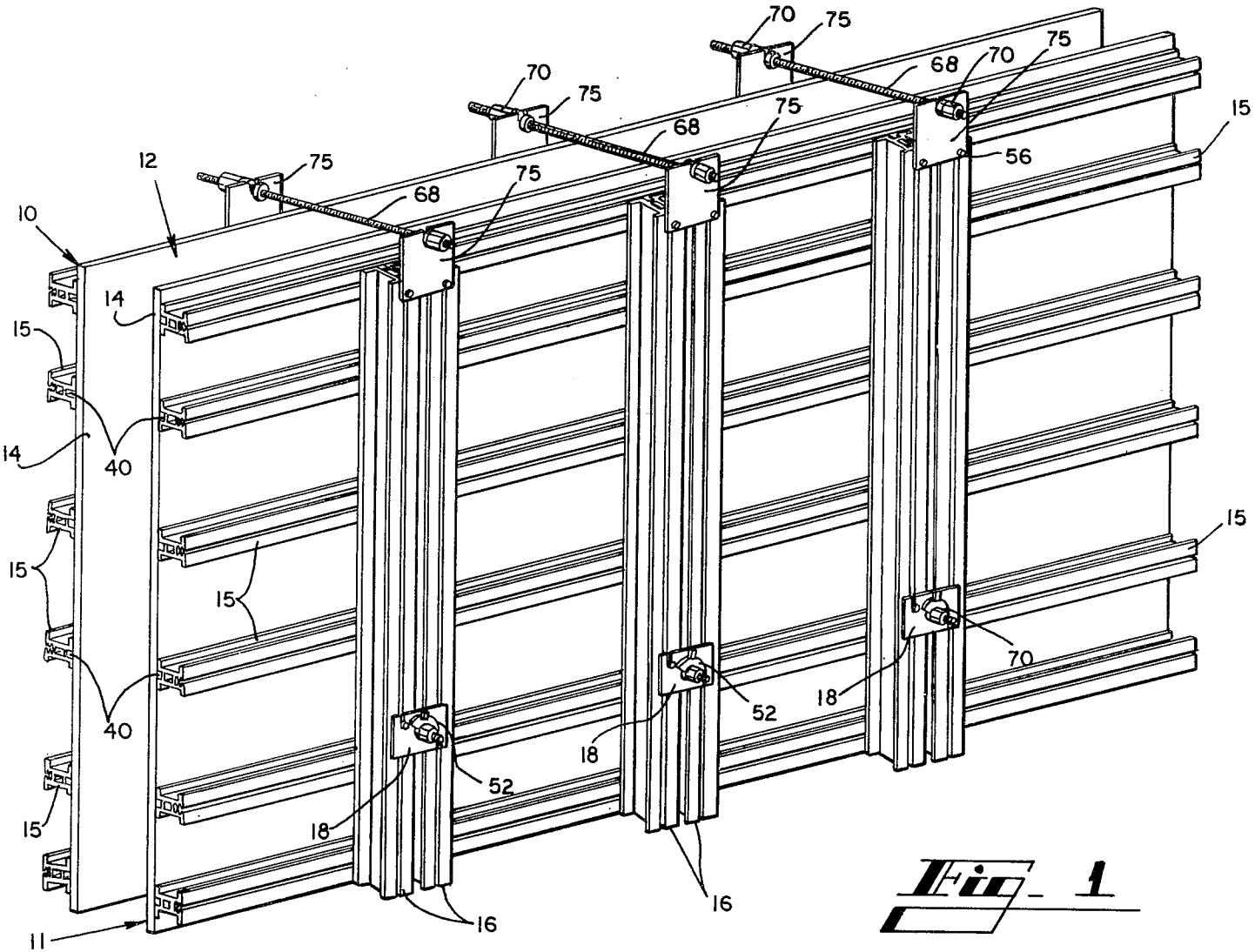
FIG. 1 is a perspective view of a completed wall form in accordance with the present invention.
Figure 4:
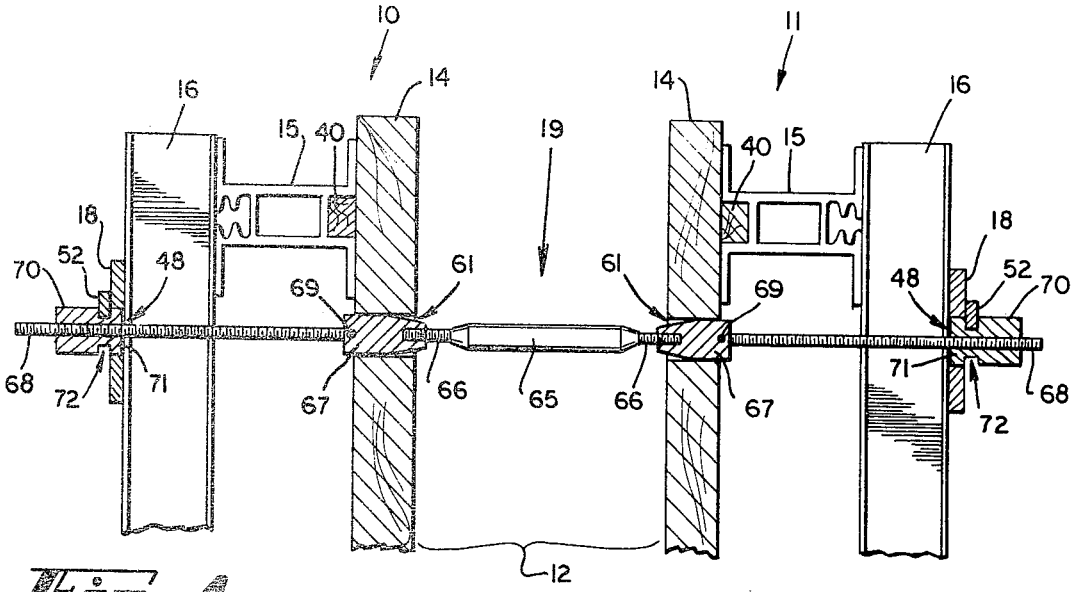
FIG. 4 is an isolated sectional view showing a lower tie rod assembly of the wall form in FIG. 1.
Figure 5:
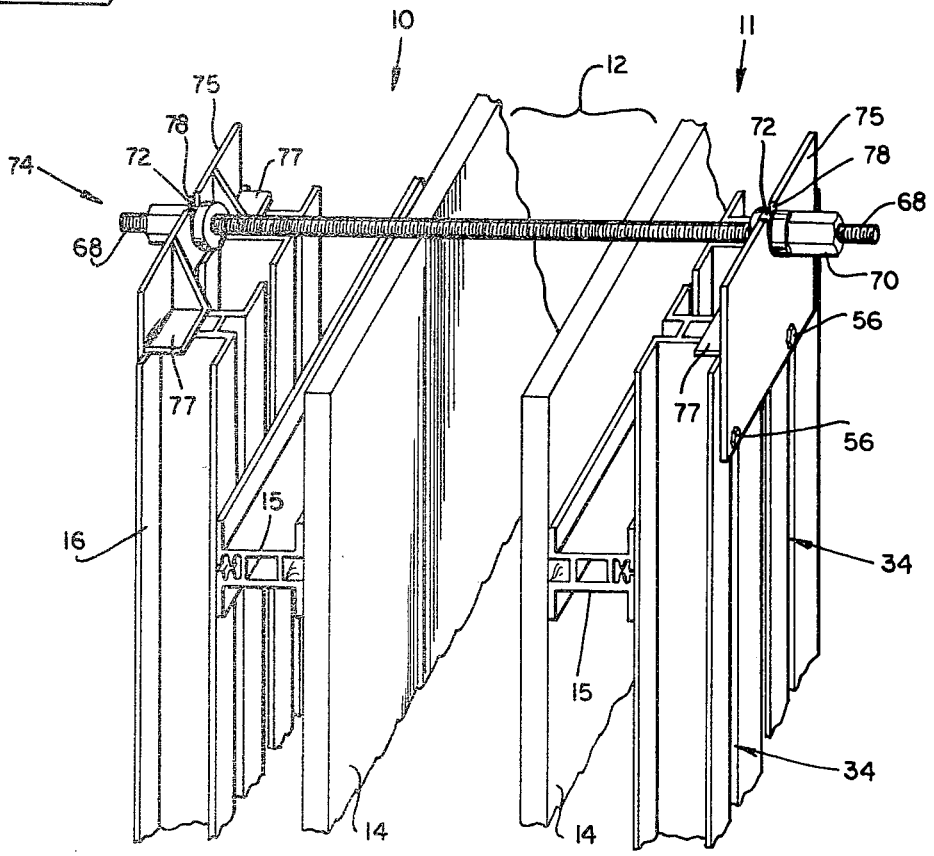
FIG. 5 is an isolated perspective view showing an upper tie rod assembly of the wall form in FIG. 1.

Referring now to the drawings in which like numerals represent like components throughout the several views, FIG. 1 shows a segment of assembled concrete wall forms including two opposing half wall forms 10,11 which define a wall space 12 between them to be filled with concrete. Each opposing half wall form 10,11 is comprised of a plywood form 14 supported by a supporting framework including a series of parallel stringers 15 and series of parallel stiffbacks 16 attached to and perpendicular to the stringers. The stringers 15 are attached to the plywood 14 and the stiffbacks 16 are then attached to the stringers. A plurality of tie rod plates 18,75 join together pairs of stiffbacks 16 and span the area between the two stiffbacks of each pair. The upper tie rod plates 75, called tie rod support plates 75, extend above the plywood form 14. The two opposing half wall forms 10,11 are tied together by a number of tie rod assemblies 19,74 (see FIGS. 4 and 5) extending across the wall space 12. The lower tie rod assemblies 19 protrude through each plywood form 14 at points between the two stiffbacks 16 of each of the stiffback pairs and then through the holes 48 in the lock plates 18. The upper tie rod assemblies 74 cross the wall space 12 above the plywood form 14 and are supported by the upper plates 75.

Figure 2:
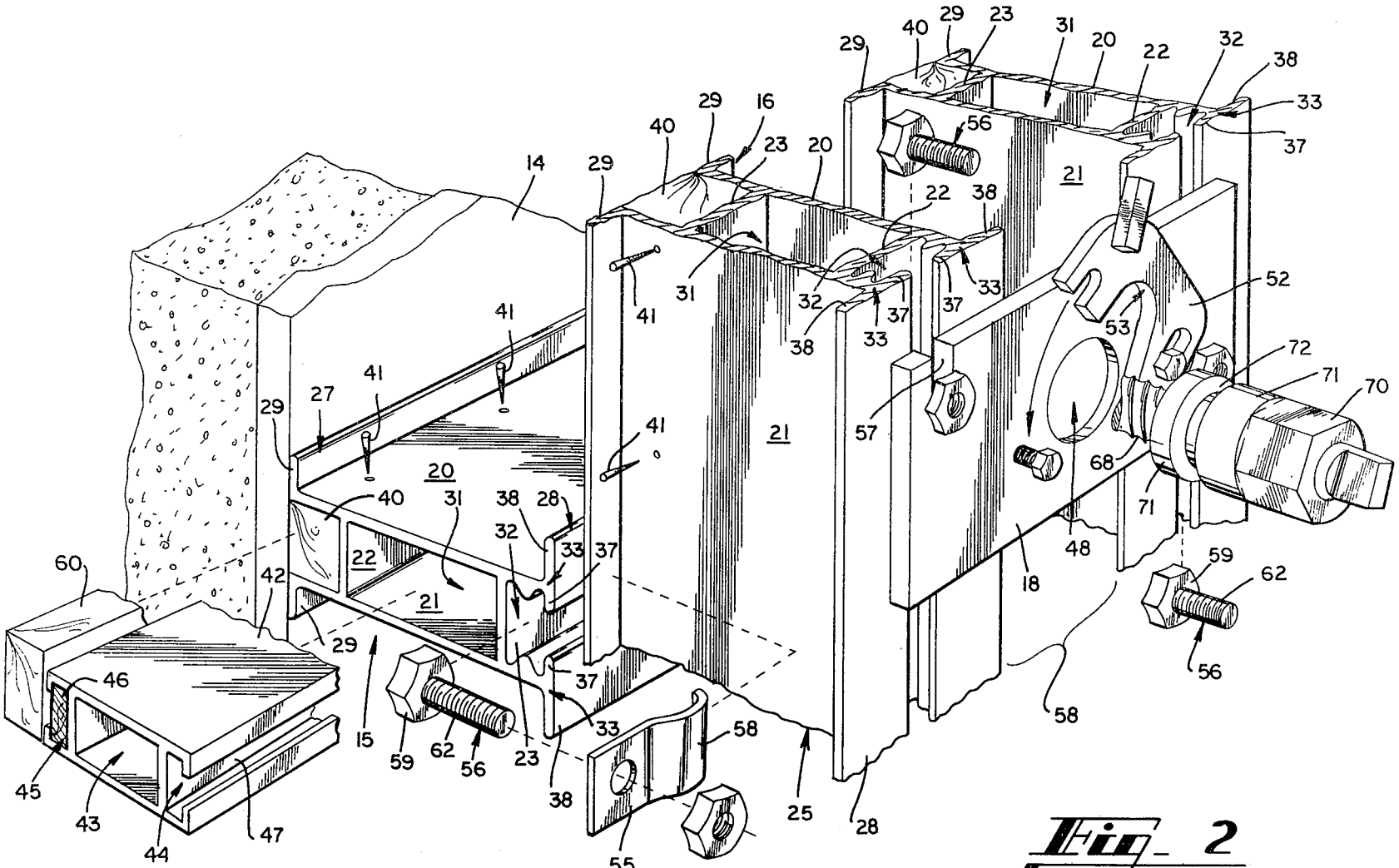
FIG. 2 is an isolated perspective view of the wall form in FIG. 1.
Figure 3:
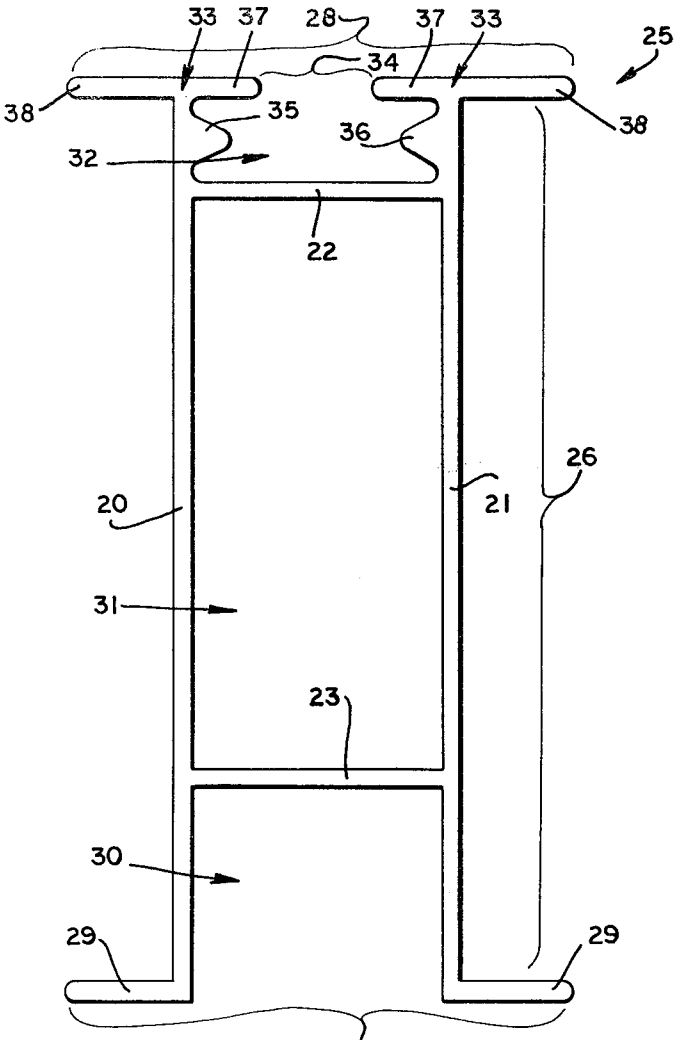
FIG. 3 is an end view of a beam component of the wall form in FIG. 1.

A more detailed view of the wall form components is seen in FIGS. 2 and 3. The stringers 15 and stiffbacks 16 are identically shaped beams 25 being generally "H" shaped in profile (see FIG. 3). Each beam 25 comprises a central web portion 26 which includes a pair of spaced apart parallel side walls 20,21. The side walls 20,21 are connected together by a pair of spaced apart parallel internal walls 22, 23 which are perpendicular to and positioned between the side walls 20,21. The beam 25 further includes a front face 27 and a back face 28. The front face 27 comprises an outwardly turned front flange 29 formed at the front edge of each side wall 20,21. The back face 28 comprises a back flange 33 including an inwardly turned portion 37 and an outwardly turned portion 38 formed at the back edge of each side wall 20,21. The flanges 29, 33 of each beam face 27,28 are in a common plane and all flanges 29, 33 are parallel to one another. The central web portion 26 defines three channels formed therein, each channel running the full length of the beam 25. A first grooved channel or board receiving channel 30 in the front portion of the central web portion 26 is generally rectangular in profile but is open on the side along the front edge 27 of the beam 25. The channel 30 is bounded by the two parallel side walls 20,21 of the central web 26 and by the first of the two internal walls 23, with the fourth side being totally open along the front face 27 of the beam 25. The second channel 32 is a bolt holding channel 32 and is formed in the back portion of the central web 26. The second channel 32 is generally rectangular in profile, being bounded on two sides by the parallel side walls 20, 21 of the central web 26 and on a third side by the second of the internal walls 22. The fourth side of the bolt holding channel 32 is bounded by the two inwardly turned portions 37 of the back flanges 33. These inwardly turned flanges 37 do not meet and thereby form a gap or slot 34 centrally located in the back face 28 of the beam 25, leading into the bolt holding channel 32 and running the full length of the beam. An inwardly jutting ridge or rib 35,36 is formed on each of the two parallel side walls 20,21 within the second channel 32. A third channel 31 is a long, hollow cavity positioned approximately in the center of the central web 26, and is rectangular in profile being enclosed on all four sides by the two side walls 20,21 and the two internal walls 22,23.

A wooden nailer 40 is fastened by self tapping screws 41 in the first channel 30 of each beam 25. A rectangular extension slider or splicer 42 is telescopically insertable into the cavity of the third channel 31 of each beam. Each slider 42 comprises a central cavity 43 and an identically shaped bolt-nailer channel 44,45 on each of two opposing ends of the slider. Each channel 44,45 has a lengthwise extending central opening 47 in its outer wall. A thin wooden nailer 46 is held by one of the bolt-nailer channels 45 of each slider 42.

The lower tie rod plates or lock plates 18 each comprise a centrally located lock hole 48. An aproximately "C" shaped locking collar 52, including a central indentation 53, is hingedly attached to the lock plate 18 with its central indentation 53 capable of alignment with the lock hole 48. A number of lower tie rod assemblies 19 act in conjunction with the lock plates 18 of each half wall form 10,11 (see FIG. 4). Each lower tie rod assembly 19 comprises an inner tie 65 which, after the concrete is poured, becomes irretrievaly lost within the wall. The inner tie 65 has two threaded ends 66 each of which is threaded into an internally threaded tapered core 67. Each tapered cone 67 is removably attached by a dowl pin 69, to a threaded tie rod 68 of any desired length which extends outwardly from the plywood form 14 between the connected pairs of stiffbacks 16 and through the lock hole 48 in the lock plate 18. A tie rod nut 70 is threaded onto the tie rod 68 so that the nut 70 can travel the length of the tie rod 68 when the nut is turned. The tie rod nut 70 comprises a neck portion 71 and an annular groove 72 is formed in the neck portion.

A number of upper tie rod assemblies 74 (see FIG. 5) span between the half wall forms 10,11 above the plywood forms 14. Each upper tie rod assembly 74 is supported by two tie rod plates or tie rod support plates 75. One tie rod support plate 75 is bolted on each half wall form 10,11 by bolts 56 to the bolt channels 32 of two adjacent stiffbacks 16. The tie support plate 75 extends above the stiffbacks 16 and above the plywood form 14. Each plate includes two support flanges 77 which rest on the upper surfaces of the stiffbacks 16 and a cradling notch 78. A threaded tie rod 68 of any desired length, including tie rod nuts 70 on each end, stretches between the two half wall forms 10,11 and is supported with the annular grooves 72 of the tie rod nuts 68 held in the cradling notches 78 of the support plates 75.

The method of constructing the wall forms 10 or 11 is as follows: A number of beams 25 are chosen to be used as stringers 15 and wooden nailers 40 are fastened by self-tapping screws 41 in the board receiving channel 30, that is, the first grooved channel 30, of each stringer. These nailers 40 can be fastened ahead of time to all beams 25 in order that any beam 25 can be used as a stringer 16. The nailer 40 does not affect the use of the beam 25 as a stiffback 16 and the inclusion of a nailer 40 in all beams saves time in selection of beams. The stringers 15 are then laid on the ground in parallel alignment, as shown in FIG. 1, resting on their front faces 27. More beams 25 are chosen to be used as stiffbacks 16. The stiffbacks 16 are placed perpendicular to the stringers 15 with the front faces 27 of the stiffbacks resting on the back faces 28 of the stringers. The stiffbacks 16 are fastened to the stringers 15 by a clip 55 which is bolted to the back faces 28 of the stringer 15 by a bolt 56 slidably held in the bolt holding channel 32 of the stringer. The head 59 of the bolt 56 is slidably received into the bolt holding channel 32 with the bolt shaft 62 extending perpendicular to the back flanges 33 and through the slot 34. The inwardly jutting ribs 35,36 block the bolt head 59 and prevent the bolt 56 from turning within the channel. The inwardly turned portions 37 of the back flanges 33 prevent the bolt head 59 from pulling out of the channel 32. The clamp end 58 of the clip 55 clamps down on the outwardly turned flange 29 of the front face 27 of the stiffback 16 and holds the stiffback firmly against the stringer 15. The tie rod plates 18,75 stretch across two adjacent stiffbacks 16 and divide the series of stiffbacks into pairs. Each tie rod plate 18,75 is bolted to the back faces 28 of the stiffbacks 16 by bolts 56 slidably held in the beam bolt holding channel 32 and extending through the notches 57 in the lock plate. The central hole 48 of each lower lock plate 18 is located over the spanned space 58 between the two adjacent stiffbacks 16. The cradling notch 78 of the upper tie rod support plates 75 is also located over the spanned space 58 but can be located directly over the stiffbacks 16 if desired since the support plate 75, as in the disclosed embodiment, can extend above the stiffbacks 16.

If it becomes necessary to lengthen the stringer beam 15 so as to create a stringer of length somewhere between the length of two beams, then the extension slider 42 can be inserted into the third channel cavity 31 and telescopically adjusted to protrude the desired length. The slider 42 is held rigidly within the stringer 15 by a clip 55 of the same design as the clip 55 which holds the stringers 15 and stiffbacks 16 together. The clip 55 is bolted to the slider 42 by a bolt slidably held within the bolt-nailer channel 44 of the slider. The clamp end 58 of the clip 55 engages the stringer 15 within the stringer bolt holding channel 32. In order to widen the slider 42 and to bring the edge of the slider 42 out flush with the front face 27 of the stringer 15, a 2×4 board 60 is nailed to the thin wooden nailer 46 located in the bolt-nailer channel 45 of the slider. Once the stringers 15, stiffbacks 16, lock plates 18 and sliders 42 have been assembled, the frame work is turned on its back and the plywood forms 14 are nailed to the wooden nailers 40 and 2×4 boards 60. The half wall forms 10,11 are now complete.

When two such half wall forms 10,11 have been completed, they are stood up with the plywood forms 14 facing one another. Aligned holes 61 (see FIG. 4) are drilled in the plywood 14 of each form 10,11 in the spanned spaces 58 (see FIG. 2) of each pair of adjacent stiffbacks 16. The stiffbacks 16 of opposing wall forms 10,11 can be easily moved along the length of the stringers 15 in order to properly align opposing spanned spaces 58. The opposing half wall forms 10,11 are held in spacial relationship to each other by a number of tie rod assemblies 19,75. The lower tie rod assemblies 19, comprising the components previously described, are extended through the aligned holes 61 in the plywood 14 of each half wall form 10,11. The lower tie rod assemblies 19 are each positioned with their inner tie 65 located within the wall cavity 12; the tapered cone 67 located in the aligned holes 61 and protruding partially into the wall space 12; and the tie rods 68 passing through the lock holes 48 of the lock plates 18. The locking collars 52 are clamped around the neck 71 of the tie rod nut 70 engaging the annular groove 72 of the nut. This locking collar arrangement locks the tie rod nut 70 at a fixed distance from the plywood form 14. The threaded rods 68 of the upper tie rod assemblies 74, with a tie rod nut 70 on each end, are extended between the two opposing half wall forms 10,11 over the top of the plywood form 14. The upper assemblies 74 are supported by the upper tie rod plates 75 with the annular groove 72 of each nut 70 resting in the cradling notch 78 of the plate 75. The cradling notch 78 holds the tie rod nut 70 at a fixed distance from the plywood form 14. Thus, in both the upper and lower tie rod assemblies, turning of the tie rod nuts 70 causes the tie rods 68 to travel through the nuts and to vary the width of the wall space 12 by drawing the opposing half wall forms 10,11 closer together or pushing them further apart. The concrete wall form is now structurally complete, adjustable and ready to accept concrete in the wall cavity 12.

Figure 6:
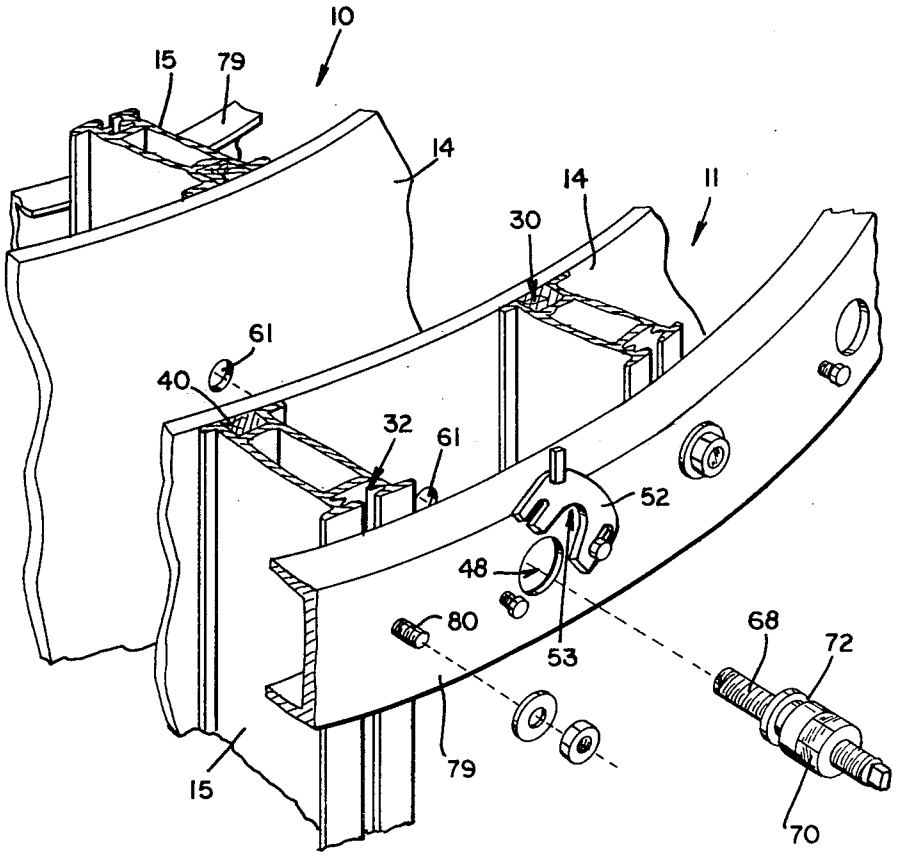
FIG. 6 is an isolated perspective view of a second embodiment of the wall form in accordance with the present invention.

A second embodiment of the invented wall form system is shown in FIG. 6. This second embodiment is a form for forming curved walls. The opposing half wall forms 10,11 each comprise a curved plywood form 14. The previously described H-shaped beams 25 are used as stringers 15 and are run vertically along the curved plywood form 14. The plywood 14 is nailed to the nailer 40 fastened in the grooved channel 30 of the stringer beam 15. A plurality of rigid stiffbacks 79, of different design than the H-beam 25, back up the stringers 15 and run perpendicular to the stringers. The stiffbacks 79 are rolled channel beams 79 curved to follow the curve of the plywood form 14 and are fastened abutting the back flanges 28 of the stringers 15 by bolts 80 held in the bolt holding channels 32 of the stringers beams 15 and passing directly through the stiffbacks 16. These rolled beams 79 can be cold rolled to any desired radius and subsequently rerolled to change the radius for use on a differently curved wall form. In this embodiment, the rolled channel stiffback 79 functions as, and is, the lock plate and the lock hole 48 is cut directly out of the stiffback 79 in alignment with the aligned holes 61 in the plywood forms 14. The locking collars 52 are hingedly mounted on the stiffbacks 16 with their central indentations 53 capable of alignment with the lock hole 48. The tie rod 68, tie rod nut 70 and the remainder of the tie rod assembly 19 function in conjunction with the locking collar 52, lock hole 48 and aligned holes 61 in similar manner as the lower tie rod assembly 19 of the previously described embodiment. There is no upper tie rod assembly in this embodiment.

While this invention has been described in specific detail with particular reference to preferred embodiments thereof, it will be understood that variation and modifications can be effected within the spirit and scope of the invention as described hereinbefore and as defined in the appended claims.

What is claimed is:

1. In a forming structure for use in the forming of concrete walls comprising a form, a plurality of rigid stringers attached to said form to act as support ribbing for said form, a plurality of rigid spaced apart stiffback supports oriented perpendicular to the stringers and attached to the stringers, a plurality of tie rods passing through the form with a tie rod nut including a neck portion with an annular groove defined in the neck portion threaded onto the tie rod at each of the ends of the tie rod, the improvement therein comprising a plurality of lock plates mounted on adjacent stiffbacks and spanning the space between said adjacent stiffbacks, a hole in each lock plate between said stiffbacks into which said tie rod nut is insertable, a locking collar attached to each said lock plate, each of said locking collars defining a slot extending inwardly from one of its edges of a breadth less than the breadth of the hole of its lock plate, each said locking collar being pivotably connected on one side of its slot to its said lock plate on one side of the hole in its lock plate and movable to a position with its slot aligned with the hole of its lock plate for releasably engaging said annular groove of said tie rod nut when said nut is inserted in said hole, and means for connecting each said locking collars to its locking plate on the side of the slot of the locking plate opposite to the pivotable connection of said locking collar to its lock plate, whereby each said lock plate holds a tie rod nut at a constant distance from its form and the tie rod nuts are exposed for rotation on their tie rods.

2. In a forming structure for use in the forming of concrete walls comprising a pair of spaced parallel forms defining a wall space therebetween, a plurality of rigid stringers attached to said forms on the surfaces thereof facing away from the wall space to act as support ribbing for said forms, a plurality of rigid spaced apart stiffbacks extending across said stringers and attached to said stringers, a plurality of tie rods passing through the forms with tie rod nuts each including a neck portion with an annular groove defined in the neck portion threaded onto the tie rod on opposite sides of the wall space, the improvement therein comprising a plurality of lock plates mounted on adjacent stiffbacks and spanning the space between said adjacent stiffbacks, a hole in each lock plate between said stiffbacks into which said tie rod nut is insertable, a locking collar movably mounted on each said lock plate and defining a slot extending inwardly from one edge thereof of a breadth less than the breadth of the hole of its said lock plate, said locking collar being movable to position its slot into alignment with the hole of its lock plate for releasably engaging said annular groove of said tie rod nut when said nut is inserted in said hold, and means for rigidly connecting said locking collar in position about its tie rod nut whereby each said lock plate holds a tie rod nut at a constant distance from its form.

3. A forming structure for use in the forming of concrete walls comprising a pair of spaced parallel forms defining a wall space therebetween, a plurality of rigid stringers attached to said forms to act as support ribbing for said forms, a plurality of rigid spaced apart stiffbacks extending across said stringers and attached to said stringers, a plurality of tie rods passing through the forms with a tie rod nut threaded onto the ends of each tie rod on opposite sides of the wall space, lock plates mounted on said stiffbacks, each said lock plate defining an opening therein for extending about a tie rod nut, a locking collar for each lock plate, each locking collar defining a slot extending from an edge portion thereof of a breadth less than the breadth of the opening of its lock plate, each said locking collar being pivotably connected on one side of its slot to its lock plate at a position on one side of the opening of its lock plate, and means for connecting each locking collar to its lock plate on the other side of the opening of the lock plate with the slot of the locking collar aligned with the opening of the lock collar and in engagement with the tie rod nut for holding the forms in a desired position with respect to each other.

* * * * *